United States Patent [19]

Ebmeyer et al.

[11] Patent Number: 4,838,977

[45] Date of Patent: Jun. 13, 1989

[54] PROCESS AND APPARATUS FOR MAKING PLASTIC CARRYING BAGS OR SACKS

[75] Inventors: Wilfried Ebmeyer, Enger; Fritz Achelpohl; Friedhelm Mundus, both of Lengerich, all of Fed. Rep. of Germany

[73] Assignee: Windmoeller & Holscher, Lengerich, Fed. Rep. of Germany

[21] Appl. No.: 899,697

[22] Filed: Aug. 22, 1986

[30] Foreign Application Priority Data

Aug. 22, 1985 [DE] Fed. Rep. of Germany ..... 3530070
May 14, 1986 [DE] Fed. Rep. of Germany ..... 3616262

[51] Int. Cl.[4] ..... B31B 1/64

[52] U.S. Cl. ..... 156/252; 156/251; 156/498; 156/515; 493/190; 493/195; 493/200; 493/203; 493/209; 493/238; 493/267

[58] Field of Search ..... 156/251, 498, 515, 252; 493/189, 190, 194–197, 199–204, 209, 226, 227, 229, 235, 237–239, 267; 383/120, 121

[56] References Cited

U.S. PATENT DOCUMENTS

| | | | |
|---|---|---|---|
| 439,849 | 11/1890 | Kelliher . | |
| 3,143,277 | 5/1961 | La Fleur | 229/57 |
| 3,291,373 | 6/1965 | Joyce | 229/53 |
| 3,357,152 | 12/1967 | Geigel | 53/29 |
| 3,580,486 | 5/1971 | Kugler | 229/54 |
| 3,748,205 | 7/1973 | Adams | 156/252 |
| 4,476,979 | 10/1984 | Reimann et al. | 206/554 |
| 4,554,192 | 11/1985 | Benoit | 428/35 |
| 4,571,235 | 2/1986 | Benoit | 493/239 |
| 4,636,190 | 1/1987 | Herder | 493/196 |
| 4,655,737 | 4/1987 | Benoit | 493/194 |

*Primary Examiner*—Caleb Weston
*Attorney, Agent, or Firm*—Fleit, Jacobson, Cohn & Price

[57] ABSTRACT

To make plastic carrying bags or sacks, sections are cut or are severed by hot wire welding from a gusseted tubular film by a formation of transverse seam welds and transverse severing cuts or by hot wire-welded transverse seam welds. At least in their bottom portion the sections are provided with corner seam welds, which are separately formed in the two folds and which diverge obliquely from the outer fold lines toward the top and/or bottom seam weld and terminate short of the inner fold line and merge into the latter. To prevent in the making of the carrying bags an elongation of the intermediate portion of the tubular film, the latter is initially formed with corner seam welds only in one fold of each of the two gussets before the transverse seam welds and transverse severing cuts or hot wire-welded transverse seam welds are formed. When said corner seam welds have cooled, congruent corner seam welds are formed in the respective other folds.

11 Claims, 3 Drawing Sheets

PROCESS AND APPARATUS FOR MAKING PLASTIC CARRYING BAGS OR SACKS

This invention relates to a process of making plastic carrying bags or sacks, which are severed or hot-wire welded by transverse seam welds and transverse severing cuts or by hot wire-welded transverse seam welds from gusseted tubular webs and which at least adjacent to their bottom are provided with corner seam welds which are separately formed in the two gussets and diverge obliquely from the outer fold lines toward the top and/or bottom seam welds and terminate short of and merge into the inner fold line.

In gusseted carrying bags, sacks or bags, the corner seam welds permit the formation of parallel-epipedic bottoms.

In the making of the carrying bags or sacks, the plastic tubular films are under a certain stress. If all four corner seam welds are formed in a welding station at the same time, the gusset portions of the tubular film can no longer transmit the tensile stress because the seam welds are plastic so that the corner seam weld portions are pulled apart and the intermediate portion of the tubular film is elongated and the desired strength of the corner seam welds cannot be achieved. For this reason it is an object of the invention to provide a process which is of the kind described first hereinbefore and in which an elongation of the intermediate portion of the tubular film is prevented in the making of the carrying bags.

In a process which is of the kind described first hereinbefore this object is accomplished in accordance with the invention in that the tubular film is formed with corner seam welds in only one fold of each of the two gussets before the transverse seam welds or severing cuts or of the hot wire-welded transverse seam welds are formed and when said corner seam welds have cooled the other folds are formed with congruent corner seam welds.

In the process in accordance with the invention the two folds of the two gussets are successively formed with corner seam welds so that the tensile stress acting on the seam weld can be transmitted by the folds of the gussets which have not yet been provided with a fresh corner seam weld. As a result, the tensile stresses are transmitted by those folds of the gussets which have not yet been provided with a corner seam weld or which have corner seam welds which are sufficiently strong because they have already cooled. For this reason the process in accordance with the invention ensures not only that the intermediate portion of the tubular film will not be elongated but ensures also that the fresh corner seam welds will not be subjected to excessively high tensile stresses.

Apparatus for carrying out the process in accordance with the invention, comprising feed rollers for pulling the tubular film ahead and spaced apart means for forming the corner seam welds and the transverse seam welds and severing cuts or the hot wire-welded seam welds is characterized in accordance with the invention in that the welding means for consecutively forming the corner seam welds in each of the two folds of the two gussets are spaced apart and two cooled platelike bodies are disposed between said welding means and extend between the two folds of each gusset. By said cooling plates, the cooling time of the corner seam welds is greatly shortened so that the distance between the welding means can be reduced.

The platelike body suitably consists of a highly heat-conductive material, such as copper, and is connected to coolant lines.

In a carrying bag which is of the kind described first hereinbefore and known from U.S. Pat. No. 4,554,192 the corner portions defined by the corner seam welds are severed closely beside or at a small distance from the corner seam welds. Said severed corner portions constitute waste and for a saving of material must be regranulated or utilized in a different manner.

If the corner portions are cut from the tubular plastic films when they are still continuous, said films will be weakened adjacent to the gussets, which constitute their strongest portions, so that the tubular plastic films can no longer transmit the tensile stresses without an elongation of their intermediate portions and a resulting shifting of the gusset portions. This is due to the fact that the tubular plastic films are under a certain stress during the making of carrying bags or sacks.

In accordance with a different proposal, the object stated hereinbefore is accomplished in a process of the kind involved here in that before the transverse seam welds and transverse severing cuts or the hot wire-welded seam welds are formed the tubular film is provided with the corner seam welds and on their sides facing the transverse seam welds or hot wire-welded seam welds with perforation lines which have approximately the same length and are spaced from and substantially parallel to the transverse seam welds or hot wire-welded transverse seam welds and the corner portions defined by the perforation lines and the transverse severing cuts or hot wire-welded transverse seam welds are torn off before the bags are stacked.

In accordance with that further proposal of the invention, bags or sacks from which the corner portions have been removed during the manufacturing operation can be made without a disturbance whereas the intermediate portion of the tubular plastic film from which the bags or sacks are made is not elongated during the manufacturing process and the gusset portions are not caused to warp.

In the second variant of the process in accordance with the invention, no cuts are made for severing the corner portions and as a result the starting tubular film can transmit sufficiently high tensile stresses particularly also in its gusset portions because lands are left between adjacent perforations. Said lands prevent an undesired elongation of the intermediate portion of the initial tubular film and a warping or gaping of the gusset portions.

As soon as the transverse seam welds and transverse severing cuts or the hot wire-welded transverse seam welds which adjoin the inner end portions of the corner seam welds, have been formed, the corner portions can be torn off in that the bag sections are withdrawn by feed rollers or the like. The corner portions can be collected and re-used.

In accordance with a further feature of the invention the corner seam welds are angled or similar to a hockey stick and their inner legs extend parallel to the inner fold line. By that design it is ensured that the transverse seam welds or hot wire-welded transverse seam welds being formed will reliably cross the corner seam welds at their approximately parallel inner legs. As a result, inevitable tolerances during the consecutive formation of the corner seam welds and the transverse seam welds or hot wire-welded transverse seam welds will not result in a disturbance of production and in waste.

The corner seam welds and the perforation lines are suitably formed in separate stations.

In accordance with a further feature of the invention only corner seam welds adjoining one fold and perforation lines adjoining the other fold are formed in one station and corner seam welds adjoining the other folds and perforation lines adjoining the first folds are formed in a succeeding station. That design will ensure that the fresh corner seam welds will not be subjected to excessively high tensile stresses because the tensile stresses acting on the tubular film can be transmitted by those folds of the gussets which have not been provided with a fresh corner seam weld. During the formation of the succeeding corner seam welds the first corner seam welds have already been cooled sufficiently and have an adequately tensile strength.

For instance, during the processing of tubular webs made of HD plastic material, in which seam welds can be cooled quickly, all corner seam welds can be formed together with the respective perforation lines in one station.

An apparatus for carrying out the process in accordance with the invention, comprising feed rollers for pulling the tubular web ahead and spaced apart means for forming the corner seam welds and the transverse seam welds and transverse severing cuts or the hot wire-welded transverse severing cuts is characterized in accordance with the invention in that the welding means for forming the corner seam welds consist of two heated welding jaws, which are movable toward each other and away from each other by drive means, and that cooled platelike bodies, which extend between the two folds of the gussets of the tubular film, are provided, knives for cutting the perforation holes are connected to at least one of the welding jaws, and the platelike body is provided with corresponding apertures as passages for the knives.

A gusseted bag or sack which is made by the process in accordance with the invention and has a bottom and/or top seam weld extending transversely beyond the inner folds, and oblique corner seam welds, which merge into at least one of said top and bottom seams at a distance from the inner fold lines, is characterized in accordance with the invention in that the oblique portion of each corner seam weld terminates short of the inner fold line and is succeeded by a seam weld portion which is approximately parallel to the inner fold line and merges into the top and/or bottom seam weld approximately at right angles thereto.

The stacked sections which are provided with continuous transverse top and bottom seam welds and corner seam welds adjoining said top and bottom seam welds may be provided at their top edges with cutouts which are similar to those of bags resembling a sleeveless undershirt. Illustrative embodiments of the invention will now be explained more in detail with reference to the drawing, in which FIG. 1 is a diagrammatic side elevation showing a first apparatus for forming the corner seam welds and the hot wire-welded transverse seam welds.

Figure 1:
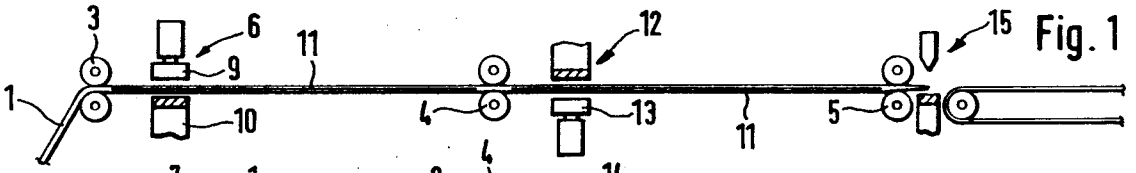
Figure 2:
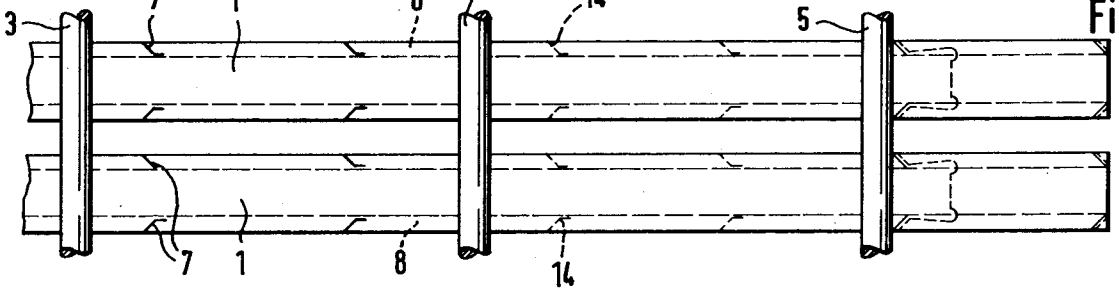
FIG. 2 is a top plan view showing the apparatus of FIG. 1.
Figure 10:
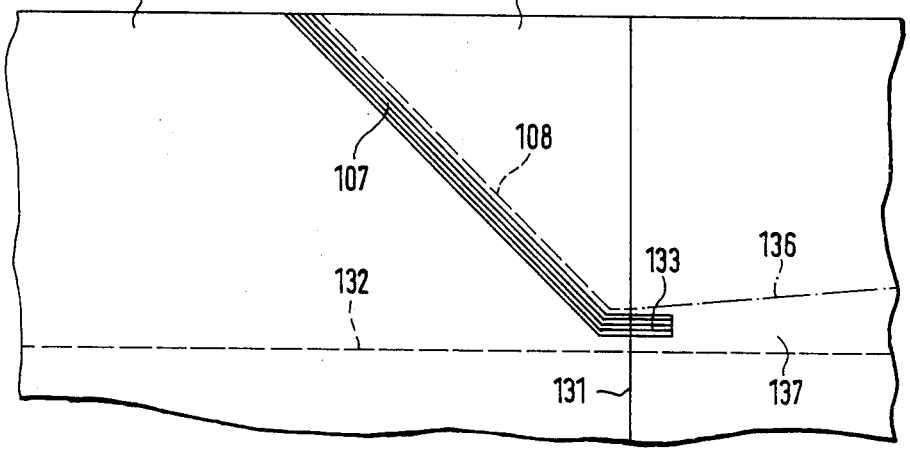

FIG. 10 is an enlarged view showing the bottom portion of a bag which is similar to a sleeveless undershirt. The apparatus shown in FIGS. 1 and 2 serves to make bags which are similar to sleeveless undershirts in a two-up arrangement. The gusseted tubular films 1 are pulled ahead by the pairs of feed rollers 3, 4, 5. Closely behind the first pair of feed rollers 3, the welding device 6 is disposed, which forms corner seam welds 7 in the upper folds of the gussets 8 of the tubular films 1. The welding device 6 consists of a movable upper welding bar 9 and a backing lower jaw 10. In the machine frame, cooling plates 11 are held, which are disposed between the pairs of feed rollers 3, 4 and extend between the upper and lower folds of the gussets 8 and constitute a separating layer as the corner seam welds are welded. As the tubular films 1 are pulled ahead, the cooling plates 11 effect a rapid cooling of the freshly formed corner seam welds. The welding device 12 closely succeeds the pair of feed rollers 4 and is generally similar in design to the welding device 6 but has a movable welding bar 13, which is disposed below the plane of the films 1 so that the welding bar 13 can be used to form the corner seam welds 14 in the lower folds of the gussets 8.

The feed rollers 5 are succeeded by the transverse hot wire-welding device 15, which welds the individual bags and severs them from the films 1. When the bags have been carried away and stacked, the stacks are formed by stamping with cutouts which are similar to the neckline of a sleeveless undershirt and with cuts which define corner portions.

The distance between the welding devices 6, 12 is so selected that adequate time is available for the cooling of the corner seam welds.

The pairs of feed rollers 3, 4 are provided in gaps between the cooling plates 11. The feed rollers 3, 4, 5 are provided in conventional manner with automatically controllable transmissions, which are adapted to maintain the desired tension in the tubular film.

Figure 3:
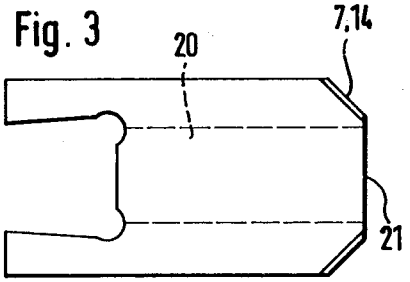
FIG. 3 is a top plan view showing a bag which is similar to a sleeveless undershirt and has corner seam welds adjacent to its bottom.

FIG. 3 shows a finished bag 20 which similar to a sleeveless undershirt and is provided at its bottom with corner seam welds 7, 14 and with a transversely extending bottom seam 21.

Figure 4:
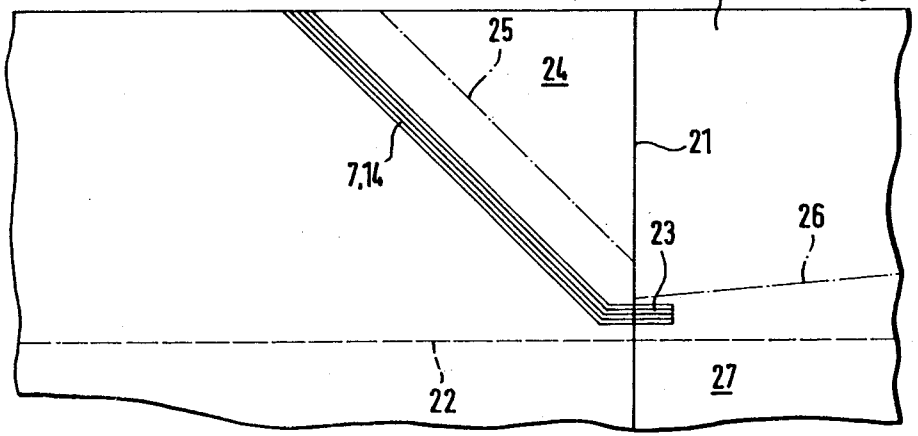
FIG. 4 is an enlarged top plan view showing a corner seam weld.

As is apparent from FIG. 4 the corner seam welds 7, 14 diverge obliquely toward the hot wire-welded transverse seam weld 21 which constitutes the bottom. In their end portions the corner seam welds 7, 14 are provided with seam weld portions 23, which are parallel to the inner fold 22 of the gussets 8 any which extend through the hot wire-welded transverse bottom weld 21. The corner portions 24 defined by seam welds are subsequently cut off along the dash-dot line 25, preferably in the stack.

The line of cut 25 must be sufficiently spaced apart from the corner seam welds 7, 14 so that the latter can never be affected by the cut. The line of cut 26 which defines the cutout that is similar to a neckline of a sleeveless undershirt is also indicated by a dash-and-dot line in FIG. 4. The corresponding cutout 27 includes that portion of the seam weld portion 23 which protrudes from the hot wire-welded transverse seam weld 21.

Figures 5, 6, 7, 8:
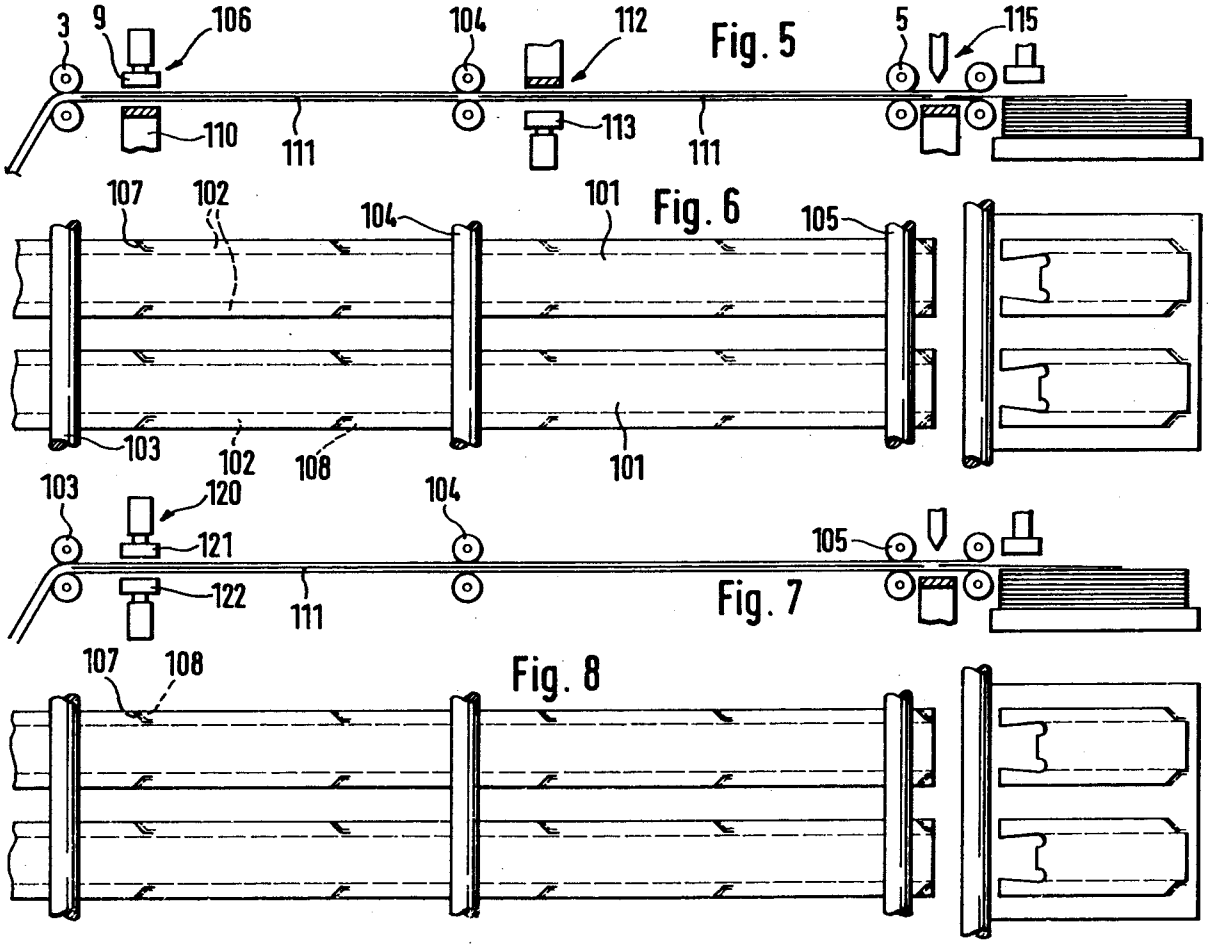
FIG. 5 is a diagrammatic side elevation showing a second apparatus for making bags which are similar to sleeveless undershirts and have corner portions which can be torn off.
FIG. 6 is a top plan view showing the apparatus in accordance with FIG. 5.
FIG. 7 shows a third embodiment, which corresponds to FIG. 1, of apparatus for making bags which are similar to sleeveless undershirts.
FIG. 8 is a top plan view showing the apparatus of FIG. 7.

The apparatus shown in FIGS. 5 and 6 serves to make bags which are similar to a sleeveless undershirt in a two-up arrangement. The tubular films 101 are provided with gussets 102 and are pulled ahead by the pairs of feed rollers 103, 104, 105. The first pair of feed rollers 103 are closely succeeded by the welding device 106, which serves to form the upper folds of the gussets 102 of the tubular film 101 with corner seam welds 107 and with perforation lines 108, which are approximately parallel to the corner seam welds. The welding device 106 is also provided with a serrated knife, which is not shown and serves to cut the perforation lines.

The welding device 106 consists of a movable upper welding bar 109 and a backing lower jaw 110. Cooling plates 111 are held in the machine frame between the pairs of feed rollers 103, 104 and extend between the upper and lower surfaces of the gussets 102 and constitute a separating layer as the corner seam welds are formed. As the tubular films 101 are pulled ahead, the cooling plates 111 affect a rapid cooling of the freshly formed corner seam welds.

The pair of feed rollers 104 are closely succeeded by the welding device 112, which is basically similar in design to the welding device 106 but has a movable welding bar 113 disposed below the plane of the film 101 so that the welding bar 113 can be used to form the corner seam welds 107 in the lower folds of the gussets 102. A perforating knife which is movable up and down is connected to the welding bar 113 and serves to cut the perforation lines 108, which are parallel to the corner seam welds 7.

The feed rollers 105 are succeeded by the transverse hot wire-welding device 115, which welds the individual bags and severs them from the films 101. The severed bags are stacked and the stacks are carried off and subsequently formed with cutouts which are similar to the neckline of sleeveless undershirts.

In the illustrative embodiment shown in FIG. 7 the pair of feed rollers 103 are succeeded by a welding device 120, which serves to form the corner seam welds and consists of upper and lower welding jaws 121, 122, which are movable up and down in step. Said welding jaws 122, 122 formed all four corner seam welds 107 at the same time on the gusseted tubular films. One of the welding jaws 121, 122 is also provided with a perforating knife, which cuts all four perforation lines 108 into the tubular films 101 at the same time. To permit a cutting through all four layers at the same time, the cooling plates 111 are formed with suitable apertures for the serrated perforating knives. The cooling plates 111 serve also as backings.

Figure 9:
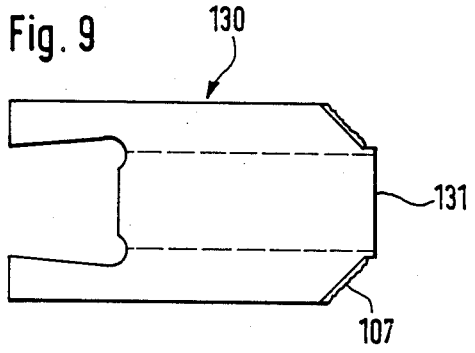
FIG. 9 is a top plan view showing a bag which is similar to a sleeveless undershirt and has been made by the apparatus shown in FIGS. 5 to 8.

FIG. 9 shows a complete bag 130, which is similar to a sleeveless undershirt and is provided at its bottom with corner seam welds 107 and with a transverse bottom seam 131.

As is apparent from FIG. 10 the corner seam welds 107 diverge obliquely toward the transverse seam weld 131 which constitutes the bottom. The end portion of the corner seam welds 107 comprise seam weld portions 133 which are parallel to the inner fold 132 of the gussets 102 and which extend through the transverse bottom seam weld 131. The perforation lines 108 are approximately parallel to the corner seam welds 107 and to the seam weld portions 133. The corner portions 134 defined by seam welds are torn off along the perforation lines 108 before the bags are stacked.

The perforation line 108 is sufficiently spaced from the corner seam welds 107 so that the corner seam welds will not be damaged as the corner portions 134 are torn off.

The line of cut 136 defining the subsequent cutout which is similar to the neckline of a sleeveless undershirt has been indicated by a dash-and-dot line. The corresponding cutout 137 comprises that portion of the seam weld portion 133 which protrudes beyond the hot wire-welded transverse seam weld 131.

We claim:

1. A process of making plastic carrying bags or sacks, said process comprising:

forming a plastic bag from gusseted tubular webs, forming corner seam welds which are separately formed in two gussets at each side of the bag, said corner seam welds diverging obliquely from outer fold lines of the bag toward the bottom of the bag and terminate short of an inner fold line of said gussets of the bag, forming said corner seam welds in only one fold of each of the two gussets before a transverse seam weld and when said corner seam welds have cooled, forming the other corner seam weld in the other fold of each of the two gussets on each side of the bag.

2. Apparatus for carrying out a process for making plastic carrying bags, said apparatus comprising:

feed rollers for feeding a tubular film, spaced apart welding means for forming corner seam welds in each of two gussets on each side of said tubular film, and two cooled platelike bodies disposed between said spaced apart welding means and extending between the two folds of each gusset.

3. Apparatus according to claim 2, wherein said bodies consists include a cooper plate connected to coolant lines.

4. A process of making plastic carrying bags or sacks, said process comprising:

forming a plastic bag from gusseted tubular webs, forming corner seam welds which are separately formed in two gussets at each side of the bag, said corner seam welds diverging obliquely from outer fold lines of the bag toward the bottom of the bag and terminate short of an inner fold line of said gussets, forming said corner seam welds with perforation lines having approximately the same length and spaced from and substantially parallel to said corner seam welds, and corner portions defined by said perforation lines are torn off before the bags are stacked.

5. A process according to claim 4, wherein said corner seam welds are angled in a hockey stick configuration and a portion of said corner seam weld extends parallel to said inner fold line of said gussets of the tubular film.

6. A process according to claim 4, wherein said corner seam welds and said perforation lines are formed in separate stations.

7. A process according to claim 4, wherein only corner seam welds adjoining one fold and perforation lines adjoining the other fold of one gusset are formed in one station and corner seam weld adjoining the other fold and perforation lines adjoining said one fold are formed in a succeeding station.

8. A process according to claim 4, wherein all corner seam welds are formed in one station together with the respective perforation lines.

9. A process according to claim 4, wherein the bags which have been stacked are provided with continuous transverse top seam welds and with bottom seam welds and with corner seam welds adjoining said top and bottom seam welds and are formed at their ends with cutouts.

10. Apparatus for carrying out a process for making plastic carrying bags, said apparatus comprising:

feed rollers for feeding a tubular film, spaced apart means for forming corner seam welds in each of two gussets on each side of said tubular film, said spaced apart means including welding means for forming said corner seam welds having two heated welding jaws, which are movable toward each other and away from each other by drive means, cooled platelike bodies extending between the two gussets on each side of the tubular film, and knives having teeth for cutting perforation holes being connected to at least one of the welding jaws, and said platelike bodies provided with corresponding apertures as passages for said teeth of said knives.

11. A method of preparing a plastic carrying bag comprising:

forming on a bottom portion of the bag two pairs of hockey stick shaped sealed seams on a collapsed gusseted tube of thermoplastic film, a blade region of said hockey stick shaped sealed seams extending parallel to and spaced from an innermost reach of said gussets, forming a transverse sealing seam at said bottom portion of the bag intersecting said blade region of said hockey stick shaped sealed seams generally at right angles, and forming an opening and handle at a top portion of the bag.

* * * * *